US011381016B2

(12) United States Patent
Hsu et al.

(10) Patent No.: US 11,381,016 B2
(45) Date of Patent: Jul. 5, 2022

(54) PLUG CONNECTOR HAVING CONTROL-ACTUATED RELEASABLE LATCH MECHANISM

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yang-Tsun Hsu, New Taipei (TW); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/033,612

(22) Filed: Sep. 25, 2020

(65) Prior Publication Data

US 2021/0098913 A1 Apr. 1, 2021

(30) Foreign Application Priority Data

Sep. 29, 2019 (CN) ..... 201910931973.X

(51) Int. Cl.
*H01R 12/72* (2011.01)
*H01R 13/506* (2006.01)

(52) U.S. Cl.
CPC ..... *H01R 12/721* (2013.01); *H01R 13/506* (2013.01)

(58) Field of Classification Search
CPC ..... H01R 12/72; H01R 12/721; H01R 12/00; H01R 13/506; H01R 13/516
USPC ..... 439/59
See application file for complete search history.

(56) References Cited

U.S. PATENT DOCUMENTS 6,257,914 B1 * 7/2001 Comerci ..... H01R 13/6273 439/357
6,976,876 B1 * 12/2005 Su ..... H01R 13/6583 439/357
6,978,514 B2 * 12/2005 Kuo ..... A45C 13/262 16/113.1
7,481,664 B1 * 1/2009 Knoll ..... H01R 13/6275 439/359
7,520,774 B2 * 4/2009 Watanabe ..... H01R 13/65918 439/493
7,591,664 B2 * 9/2009 Nomiyama ..... H01R 13/6275 439/352

(Continued)

FOREIGN PATENT DOCUMENTS

CN 209169515 * 7/2019 ..... H01R 13/633

*Primary Examiner* — Peter G Leigh
(74) *Attorney, Agent, or Firm* — Ming Chieh Chang; Wei Te Chung

(57) ABSTRACT

A plug connector for mating with a socket connector includes: a printed circuit board, an insulative housing partially covering the printed circuit board; a locking mechanism housed in the insulative housing, and an elastic piece matched with the locking mechanism, wherein the locking mechanism includes a pressing portion protruding from the insulative housing and a locking portion integrally formed with the pressing portion, one end of the locking portion exposing outside the insulative housing to be locked with the socket connector.

16 Claims, 9 Drawing Sheets

(56) References Cited

U.S. PATENT DOCUMENTS 7,601,010 B1 * 10/2009 Wu ..... H01R 13/6658 439/76.1
7,798,821 B2 * 9/2010 Liu ..... H01R 13/6658 439/76.1
7,997,909 B2 * 8/2011 Xu ..... H01R 13/6594 439/76.1
8,144,482 B2 * 3/2012 Sato ..... H01R 12/52 361/794
8,231,400 B2 * 7/2012 Phillips ..... G02B 6/4284 439/357
8,475,197 B2 * 7/2013 Zerebilov ..... H01R 13/6275 439/352
9,379,484 B2 * 6/2016 Phillips ..... H01R 13/62905
9,728,871 B1 * 8/2017 Gutgold ..... H01R 13/6275
9,780,486 B2 * 10/2017 Tanaka ..... H01R 13/639
9,865,948 B2 * 1/2018 Phillips ..... H01R 12/722
10,230,196 B2 * 3/2019 Phillips ..... H01R 13/6278
10,236,605 B1 * 3/2019 Henry ..... H01R 12/732
10,263,349 B2 * 4/2019 Phillips ..... H01R 12/79
10,263,364 B1 * 4/2019 Huang ..... H01R 13/6273
10,374,355 B2 * 8/2019 Ayzenberg ..... H05K 9/0058
2006/0261564 A1 * 11/2006 Chuang ..... B62B 1/125 280/47.27
2012/0052712 A1 * 3/2012 Wang ..... H01R 13/6275 439/352
2012/0329305 A1 * 12/2012 Ritter ..... H01R 13/6335 439/350
2014/0134898 A1 * 5/2014 Wang ..... H01R 13/6275 439/843
2014/0193993 A1 * 7/2014 Meng ..... H01R 13/633 439/352
2015/0093083 A1 * 4/2015 Tsai ..... G02B 6/4284 385/92
2016/0004022 A1 * 1/2016 Ishii ..... G02B 6/4261 385/92
2016/0054527 A1 * 2/2016 Tang ..... G02B 6/3895 385/92
2018/0131126 A1 * 5/2018 Wang ..... H01R 13/5825
2018/0212385 A1 * 7/2018 Little ..... H01R 13/504
2018/0287280 A1 * 10/2018 Ratkovic ..... H01R 12/721
2019/0058270 A1 * 2/2019 Henry ..... H01R 12/7029

* cited by examiner

PLUG CONNECTOR HAVING CONTROL-ACTUATED RELEASABLE LATCH MECHANISM

BACKGROUND OF THE DISCLOSURE

1. Field of the Disclosure

The present disclosure relates to a plug connector, in particular to a plug connector with miniaturized structure.

2. Description of Related Arts

China patent No. 209169515U discloses a plug connector which can be locked with a socket connector by pressing a button. The plug connector includes an insulative housing, a rotating shaft, a cable, a button, and a pull tape. The button is connected to the connecting member through the second rotating shaft arranged in the middle of the pair of connectors, which increases the overall size of the plug connector and is not conducive to miniaturization of the connector.

Therefore, an improved plug connector is desired.

SUMMARY OF THE DISCLOSURE

Accordingly, an object of the present disclosure is to provide a plug connector with miniaturized structure.

To achieve the above object, a plug connector for mating with a socket connector comprises: a printed circuit board; an insulative housing partially covering the printed circuit board; a locking mechanism housed in the insulative housing; and an elastic piece matched with the locking mechanism, wherein the locking mechanism includes a pressing portion protruding from the insulative housing and a locking portion integrally formed with the pressing portion, one end of the locking portion exposing outside the insulative housing to be locked with the socket connector.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
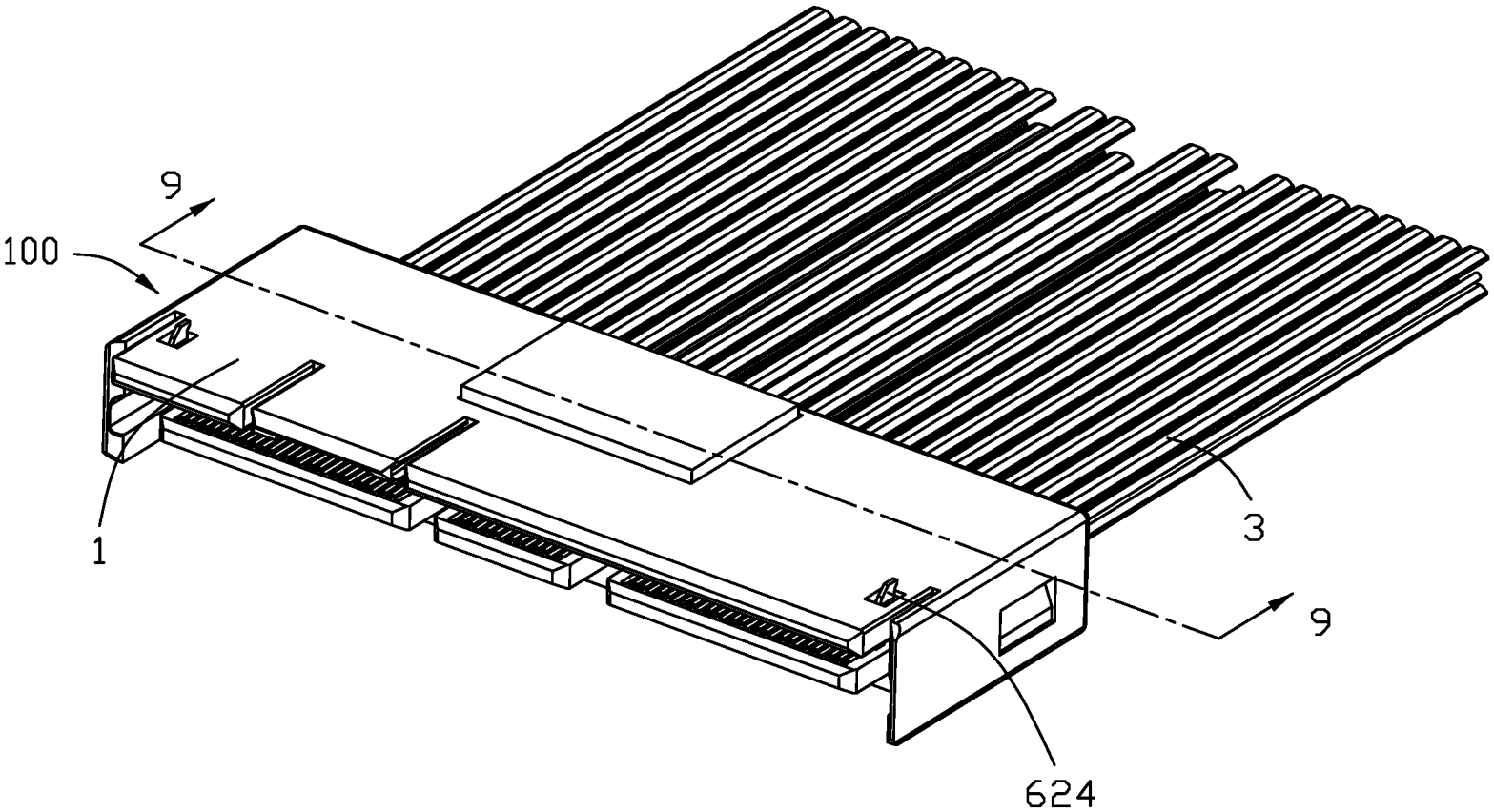
FIG. 1 is a perspective view of a plug connector according to the present invention.
Figure 2:
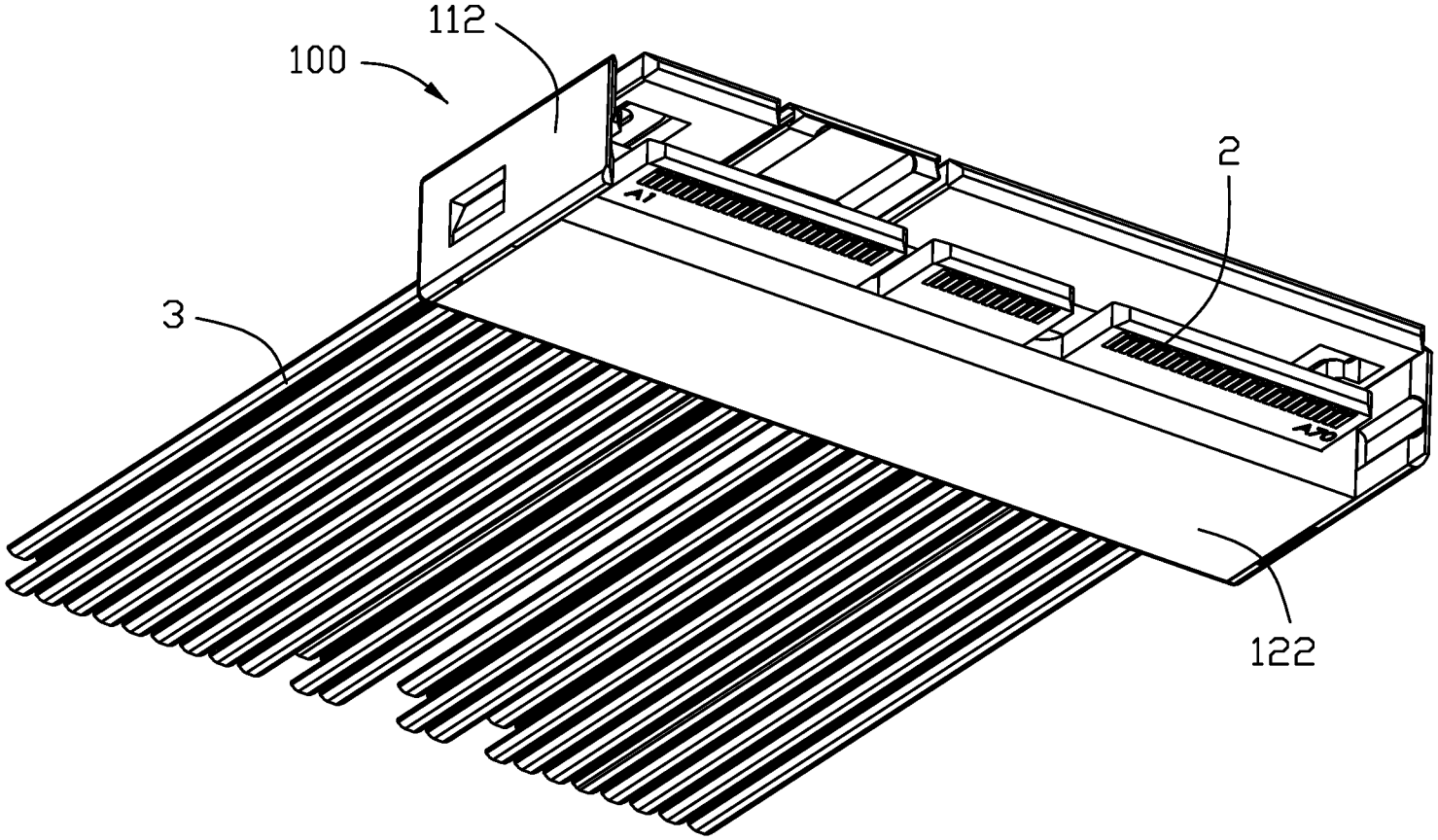
FIG. 2 is another perspective view of the plug connector as shown in FIG. 1.
Figure 3:
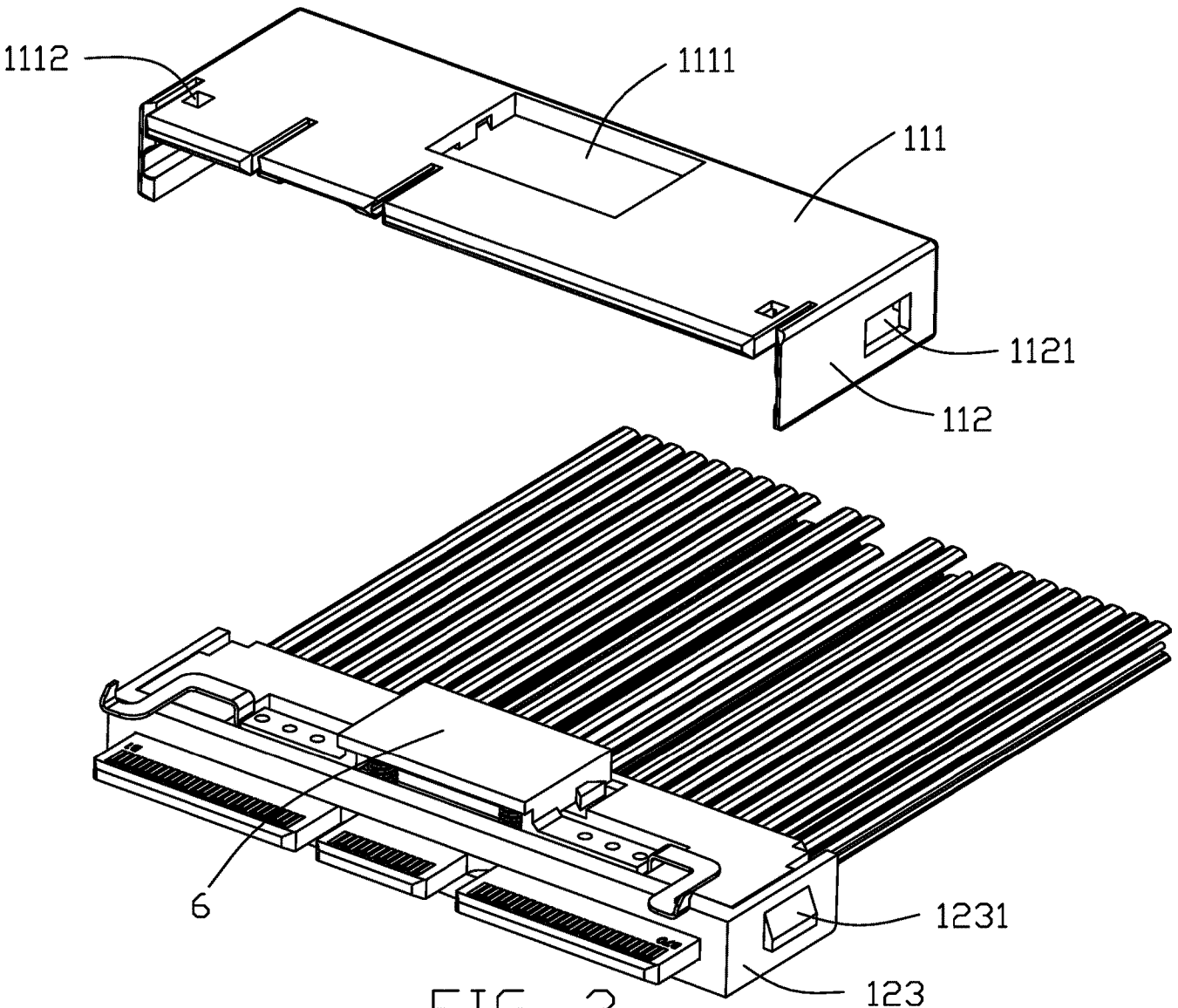
FIG. 3 is an exploded view of the plug connector as shown in FIG. 1.
Figure 4:
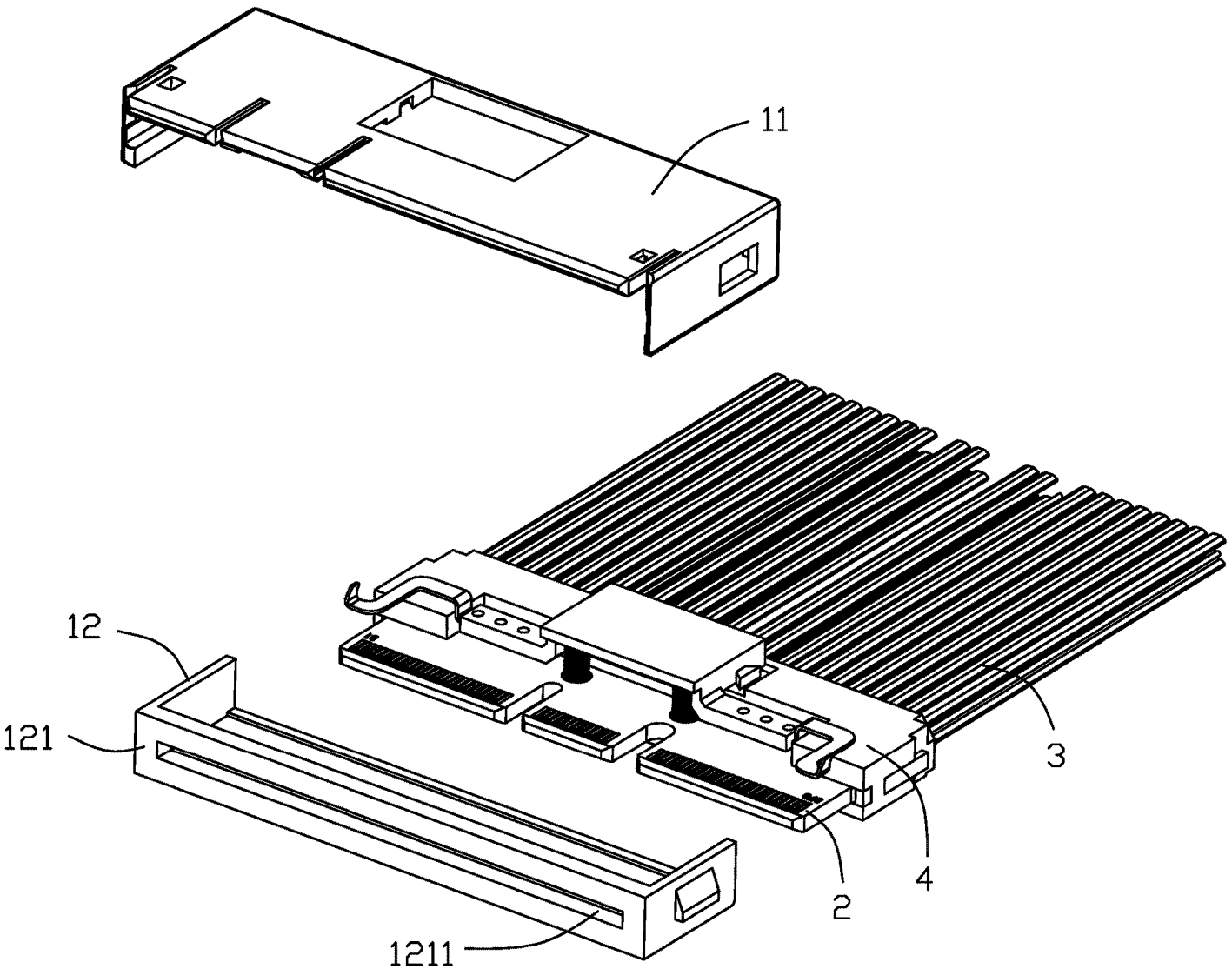
FIG. 4 is a further exploded view of the plug connector as shown in FIG. 3.
Figure 5:
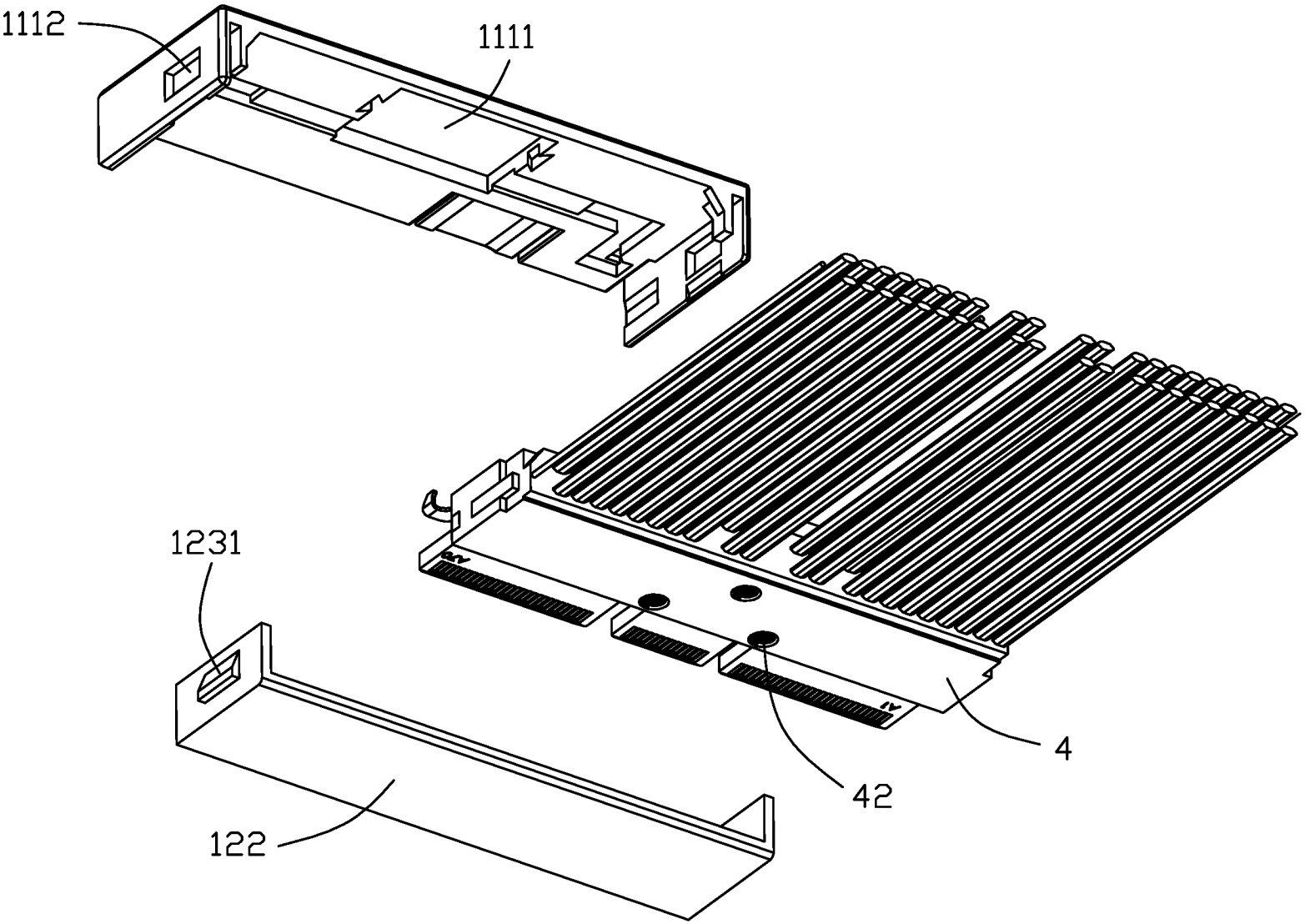
FIG. 5 is another exploded view of the plug connector as shown in FIG. 4.
Figure 6:
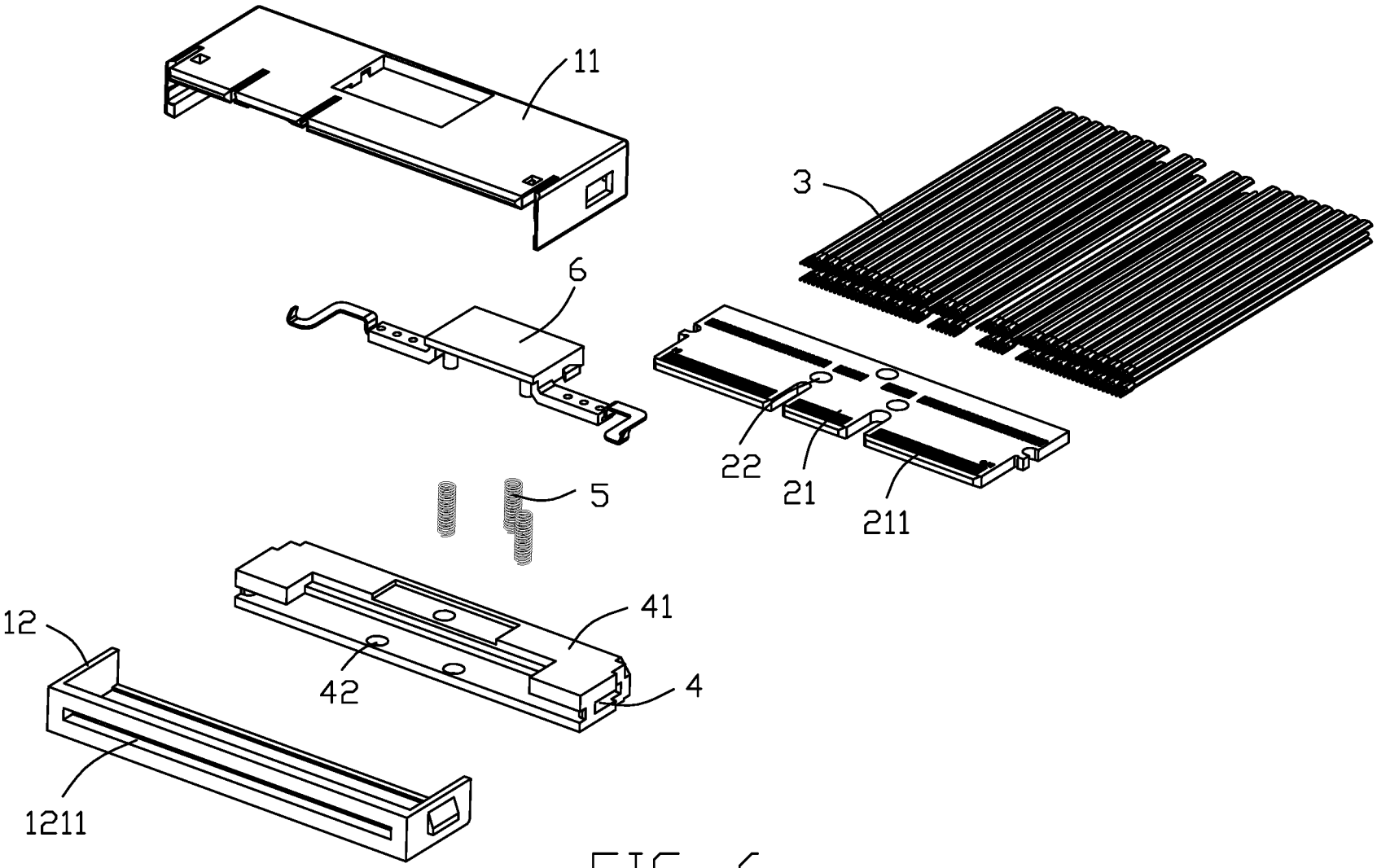
FIG. 6 is a further exploded view of the plug connector as shown in FIG. 4.
Figure 7:
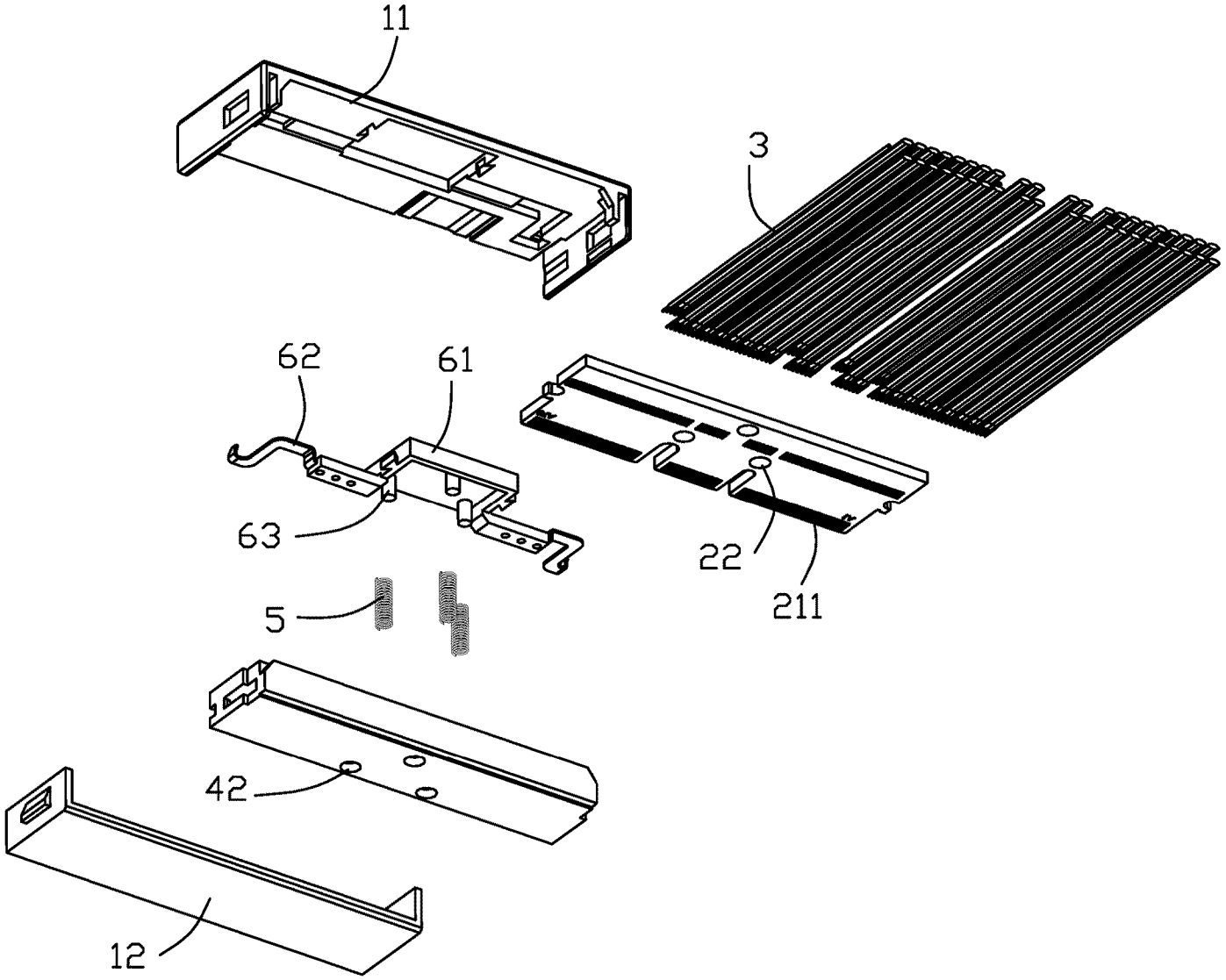
FIG. 7 is another exploded view of the plug connector as shown in FIG. 6.
Figure 8:
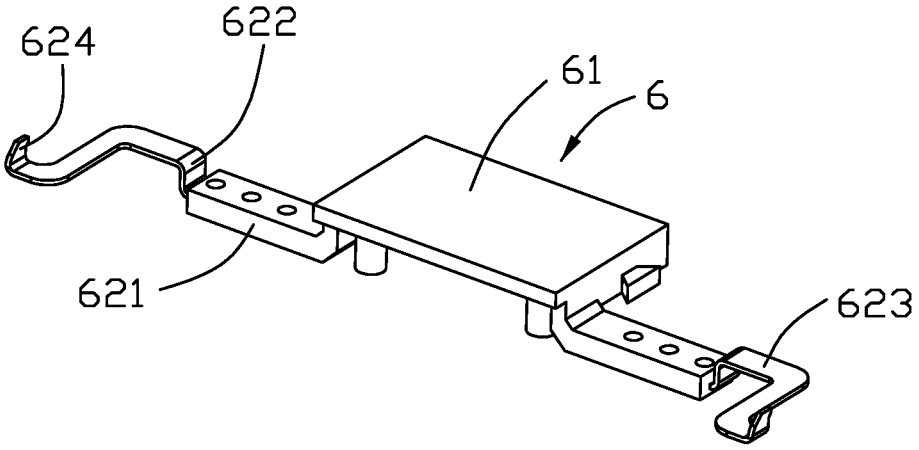
FIG. 8 is an exploded view of a locking mechanism as shown in FIG. 1.
Figure 9:
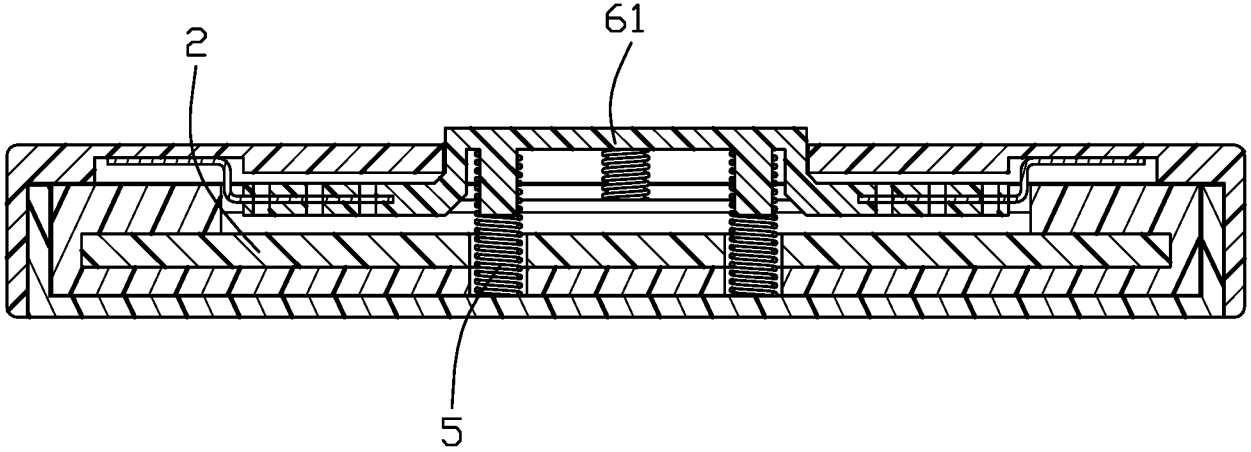
FIG. 9 is a cross-sectional view of the plug connector as shown in FIG. 1.

Referring to FIGS. 1-9, a plug connector 100 used to mate with the socket connector (not shown) includes an insulative housing 1, an inner mold 4 received in the insulative housing 1, a printed circuit board 2 partially covered in inner mold 4, a cable 3 electrically connected with the printed circuit board 2, a plurality of springs 5 received in the insulative housing 1, and a locking mechanism 6 matched with the springs 5.

The insulative housing 1 includes an upper housing 11 and a lower housing 12 assembled with the upper housing 11. The upper housing 11 includes an upper wall 111 and a pair of upper sidewalls 112 on the left and right sides of the upper wall 111. The upper wall 111 includes a square hole 1111 and a pair of through holes 1112 on the left and right sides of the square hole 1111. The upper sidewalls are respectively provided with a side hole 1121. The lower housing 12 includes a front wall 121, a bottom wall 122 opposite to the front wall 121 and a pair of lower sidewalls 123 on the left and right sides of the front wall 121. The front wall 121 includes an opening or a horizontal slot 1211 for the printed circuit board 2 to pass through. The lower sidewalls 123 are respectively provided with a projection 1231 matched with the side holes 1121.

The printed circuit board 2 is partially covered in the insulative housing 1 and includes an insertion portion 21 extending out of the opening 1211 and a plurality of first holes 22 corresponding to the spring 5. The upper and lower surfaces of the insertion portion 21 are provided with a plurality of metal plates or mating pads 211. In this embodiment, the printed circuit board 2 forms a plurality of notches (not labeled) in a front end region for receiving the corresponding keys of the socket connector (not shown) and in alignment with the corresponding first openings 22 in the front-to-back direction The front end of the cable 3 is connected to the upper and lower surfaces of the printed circuit board 2, and the rear end extends backwards out of the insulative housing 1.

The inner mold 4 covers the connection between the printed circuit board 2 and the cable 3 and includes a step 41 for holding the locking mechanism 6, and a plurality of second holes 42 corresponding to the spring 5.

The locking mechanism 6 includes an insulative pressing portion 61 passing through the square hole 1111 and protruding from the insulative housing 1, and metallic locking portions 62 extending horizontally from both ends of the pressing portion 61. The pressing portion 61 is integrally formed with the locking portion 62. The locking portion 62 includes a horizontal portion 621, a vertical portion 622 extending upward from the horizontal portion 621, a bending portion 623 connected to the vertical portion 622 and a buckle portion 624 extending upward from the bending portion 623 and out of the insulative housing 1. The buckle portion 624 extends upwardly with corresponding through holes 1112 to lock with the socket connector. The locking mechanism 6 also includes a plurality of cylinders 63 located below the pressing portion 61. The springs 5 are respectively sleeved on the corresponding cylinders 63. The cylinders 63 pass through the first holes 22 and the second holes 22 to abut on the lower housing 12.

When the plug connector 100 is mated with the socket connector, the plug connector 100 is inserted forward into the opening of the socket connector until the metal plates 211 of the printed circuit board 2 is electrically connected to the conductive terminals of the socket connector, while the buckle portion 624 of the locking mechanism 6 protrudes into the locking hole of the socket connector. When the plug connector 100 and the socket connector are unlocked, the external force presses the pressing portion 61 downward, so that the spring is compressed and the entire locking mechanism 6 moves downward until the buckle portion 624 is received in the insulative housing 1, thereby exiting the locking hole of the socket connector, and releasing the plug connection between the connector 100 and the socket connector. When the external force is removed, under the action of the elastic restoring force of the spring 5, the locking mechanism 6 moves upward, and the buckle portion 624 passes through the through holes 1112 to return to the original position.

What is claimed is:

1. A plug connector for mating with a socket connector, comprising:
- a printed circuit board;
- an insulative housing partially covering the printed circuit board;
- a cable electrically connected to a printed circuit board;
- an inner mold covering the connection between the printed circuit board and the cable;
- a locking mechanism housed in the insulative housing; and
- an elastic piece matched with the locking mechanism, wherein
- the locking mechanism includes a pressing portion protruding from the insulative housing and a locking portion integrally formed with the pressing portion, one end of the locking portion exposing outside the insulative housing to be locked with the socket connector;
- the locking mechanism includes a plurality of cylinders located below the pressing portion, and the elastic piece includes a plurality of springs respectively sleeved on the corresponding cylinders; and
- the printed circuit board is provided with a plurality of first holes corresponding to the cylinders, and the inner mold is provided with a plurality of second holes corresponding to the cylinders.

2. The plug connector as claimed in claim 1, wherein the locking portion includes a horizontal portion, a vertical portion extending upward from the horizontal portion, a bending portion connected to the vertical portion, and a buckle portion extending upward from the bending portion and out of the insulative housing.

3. The plug connector as claimed in claim 2, wherein the insulative housing includes a through hole corresponding to the buckle portion, and the buckle portion extends upwardly out of the through hole to lock with the socket connector.

4. The plug connector as claimed in claim 1, wherein the insulative housing includes an upper housing and a lower housing assembled with the upper housing.

5. The plug connector as claimed in claim 4, wherein the springs and the cylinders pass through the first holes and the second holes to abut on the lower housing.

6. The plug connector as claimed in claim 4, wherein the upper housing includes a square hole at the upper end, and the pressing portion passes through the square hole and protrudes from the insulative housing.

7. The plug connector as claimed in claim 4, wherein the lower housing includes an opening at the front end, and the printed circuit board passes through the opening to be mated with the socket connector.

8. A plug connector comprising:
- a printed circuit board having a plurality of notches alternately arranged with a plurality of mating pads in a front edge region thereof;
- an insulative housing including an upper housing and a lower housing assembled with each other to commonly sandwich the printed circuit board therebetween; and
- a locking mechanism positioned between the printed circuit board and the upper housing in a floating manner; wherein
- the locking mechanism includes an insulative pressing portion upwardly protruding through a center opening of the upper housing, and a pair of metallic locking portions integrally formed with the insulative pressing portion and having corresponding buckle portions extending upwardly through and above the upper housing;
- at least one elastic piece is located under and upwardly supporting the pressing portion; and
- the printed circuit board forms at least one through hole which the elastic piece extends through.

9. The plug connector as claimed in claim 8, wherein the pressing portion forms at least a downward protrusion to couple with the elastic piece.

10. The plug connector as claimed in claim 9, wherein the elastic piece is a coil spring and the downward protrusion is a post surrounded by the coil spring, and said coil spring downwardly abuts against the lower housing.

11. The plug connector as claimed in claim 8, wherein the through hole is aligned with one of the notches in a front-to-back direction.

12. The plug connector as claimed in claim 8, wherein the lower housing forms a horizontal slot through which the printed circuit board forwardly extends.

13. The plug connector as claimed in claim 8, further including two elastic pieces cooperating with said at least an elastic piece to form a triangular arrangement in a top view.

14. The plug connector as claimed in claim 13, wherein the pressing portion is movable along a vertical direction instead of a deflecting manner.

15. A plug connector comprising:
- a printed circuit board having a plurality of notches alternately arranged with a plurality of mating pads in a front edge region thereof;
- an insulative housing including an upper housing and a lower housing assembled with each other to commonly sandwich the printed circuit board therebetween;
- a locking mechanism positioned between the printed circuit board and the upper housing in a floating manner, the locking mechanism including an insulative pressing portion upwardly protruding through a center opening of the upper housing and a pair of metallic locking portions integrally formed with the insulative pressing portion and having corresponding buckle portions extending upwardly through and above the upper housing; and
- a first elastic piece located under and upwardly supporting the pressing portion and a pair of second elastic pieces cooperating with the first elastic piece to form a triangular arrangement in a top view.

16. The plug connector as claimed in claim 15, wherein the pressing portion is movable along a vertical direction instead of a deflecting manner.

* * * * *